US007448919B2

(12) United States Patent
Baranowski

(10) Patent No.: US 7,448,919 B2
(45) Date of Patent: Nov. 11, 2008

(54) CIGARETTE-LIGHTER ASSEMBLY CONNECTOR WITH INDICATOR FOR VERIFYING PROPER INSERTION

(75) Inventor: Conrad J. Baranowski, Westford, MA (US)

(73) Assignee: American Power Conversion Corporation, West Kingston, RI (US)

( * ) Notice: Subject to any disclaimer, the term of this patent is extended or adjusted under 35 U.S.C. 154(b) by 0 days.

(21) Appl. No.: 11/695,492

(22) Filed: Apr. 2, 2007

(65) Prior Publication Data

US 2007/0167084 A1 Jul. 19, 2007

Related U.S. Application Data

(63) Continuation of application No. 11/042,744, filed on Jan. 24, 2005, now Pat. No. 7,238,057.

(51) Int. Cl.
*H01R 24/04* (2006.01)

(52) U.S. Cl. ..... 439/668; 439/490

(58) Field of Classification Search ..... 439/668, 439/490, 700; 200/317, 314
See application file for complete search history.

(56) References Cited

U.S. PATENT DOCUMENTS

| | | | | |
|---|---|---|---|---|
| 2,489,037 | A | 11/1949 | Kailer | 439/668 |
| 5,569,053 | A | 10/1996 | Nelson et al. | 439/668 |
| 5,897,397 | A | 4/1999 | Yokozawa | 439/668 |
| 6,054,919 | A | 4/2000 | Demko | 340/479 |
| 6,368,157 | B1 | 4/2002 | Bottazzi, Jr. | 439/668 |
| 6,394,851 | B1 | 5/2002 | Paciorek | 439/668 |
| 6,551,142 | B2 | 4/2003 | Eisenbraun | 439/668 |
| 6,705,901 | B1 | 3/2004 | Lin | 439/668 |
| 6,984,138 | B2 | 1/2006 | Faunce et al. | 439/124 |
| 7,238,057 | B2 | 7/2007 | Baranowski | |

*Primary Examiner*—Michael C Zarroli
(74) *Attorney, Agent, or Firm*—Lowrie, Lando & Anastasi, LLP

(57) ABSTRACT

A cigarette-lighter assembly connector includes an indicator, particularly a light source, that can be activated when the connector is sufficiently inserted into a cigarette-lighter socket to indicate to the user that a portable electronic device can be safely operated via the power supplied from the cigarette-lighter assembly connector.

14 Claims, 2 Drawing Sheets

CIGARETTE-LIGHTER ASSEMBLY CONNECTOR WITH INDICATOR FOR VERIFYING PROPER INSERTION

RELATED APPLICATION

This application is a continuation of application Ser. No. 11/042,744 filed with the United States Patent and Trademark Office on Jan. 24, 2005, published on Jul. 7, 2006, and issued as U.S. Pat. No. 7,238,057 on Jul. 3, 2007, the entire content of which is incorporated herein by reference.

BACKGROUND

Automobiles and other vehicles are often equipped with electronic cigarette lighters mounted in the dashboard. The cigarette lighter includes a socket and a removable lighter cap. The socket includes a cathode and anode, and the lighter cap includes corresponding electrical contacts for coupling with the cathode and anode. The lighter cap also includes a high-resistance element positioned in the electrical path between the contacts of the lighter cap.

When the lighter cap is activated in the socket, electrical current flows through the high-resistance element in the lighter cap, causing the high-resistance element to become glowing hot. When the lighter cap is removed from the socket and a flammable material (e.g., the tip of a cigarette) is placed in contact with the still-glowing high-resistance element, the flammable material starts to bum. Accordingly, a driver or passenger in an auto can readily use the cigarette lighter to light a cigarette.

With the rapid spread of portable electronics (e.g., portable music players, communication devices, mobile computers, etc.) in recent years, however, the cigarette-lighter socket is now widely used as a power supply. Adapters/connectors are manufactured with terminals for contacting the cathode and anode in the socket. Those terminals are coupled with wires that lead to a power connector that can be inserted into the power-input socket of a portable electronic device.

When the user inserts the adapter/connector into the socket, a spring-loaded plunger in the connector is pressed against the cathode of the socket, while spring-loaded side terminals on the connector are pressed against the anode of the socket to create a circuit from the vehicle's battery, through the socket and connector, and ultimately to the portable electronic device. Thus powered, the electronic device can be operated as intended inside the vehicle.

SUMMARY

Described herein is a cigarette-lighter assembly connector offering improved safety and operational control. The shapes of the traditional socket and connector do not allow the user to observe the electrical terminals when the connector is inserted into the socket. Accordingly, the quality of the electrical contacts between the socket and the connector cannot be easily monitored.

For example, the connector may be inserted partially, though not fully into the socket. When the connector is fully inserted into the socket, the spring pushes the plunger of the connector against the corresponding contact in the socket, thereby promoting maximum mechanical contact between the conductive surfaces. As the contact area increases, the electrical resistance across the contact area decreases. If the connector is not fully inserted, however, the spring that biases the plunger against the contact in the socket may not be engaged or may be only slightly engaged. Hence, the conductive surfaces (due to imperfect flatness or alignment) may be in contact across only a small area of the available surfaces. The resulting limited cross-section for electric current produces a high resistance, where undesirable resistance heating will result as a consequence of power dissipation at the interface of the surfaces. That resistance heating, in turn, may damage the connector by, e.g., melting components in the connector.

The cigarette-lighter assembly connector designs described herein can remedy this potential problem by providing means for ensuring that the connector is fully inserted in the socket so as to prevent or reduce the likelihood of excessive heat generation at the connector plunger's contact surface. Specifically described is a light source in electrical communication with a terminal positioned to make electrical contact with the plunger only when the plunger is retracted a distance sufficient to engage the spring or other biasing mechanism to apply sufficient force against the plunger to ensure that an adequate contact area is created at the interface of the socket cathode and the plunger's contact surface. When the plunger is so retracted to make electrical contact between the plunger and the light-source terminal, power flows from the socket, through the plunger of the connector, across the terminal, and to the light source, which is thereby powered to emit light. The light is observed by the vehicle driver or passenger, who is thereby informed that an electronic device coupled with the connector can be safely operated without substantial risk of overheating and melting.

Further, use of the cigarette-lighter is not limited to vehicles, as the socket and assembly connector can also be used with equal effect in other settings where power is needed. Further still, the indicator that provides the notice as to whether the assembly connector is fully inserted into the socket can be in the form of something other than a light source.

BRIEF DESCRIPTION OF THE DRAWINGS

In the accompanying drawings, described below, like reference characters refer to the same or similar parts throughout the different views. The drawings are not necessarily to scale, emphasis instead being placed upon illustrating particular principles of the methods and apparatus characterized in the Detailed Description.

DETAILED DESCRIPTION

Figure 1:
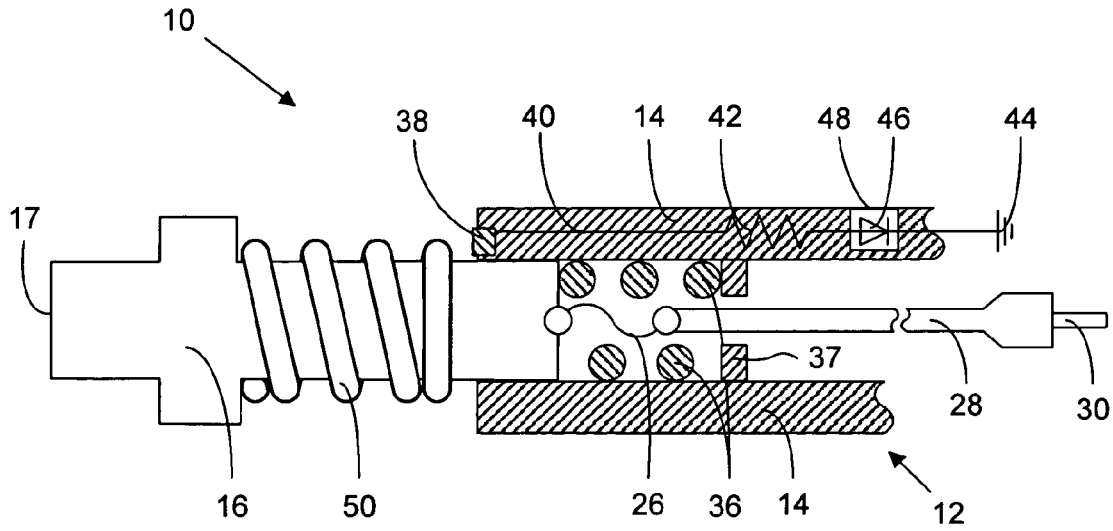
FIG. 1 is an illustration, partially sectioned and partially schematic, of an embodiment of a cigarette-lighter assembly connector, wherein the plunger is fully extended and not in electrical contact with the light-source terminal.
Figure 2:
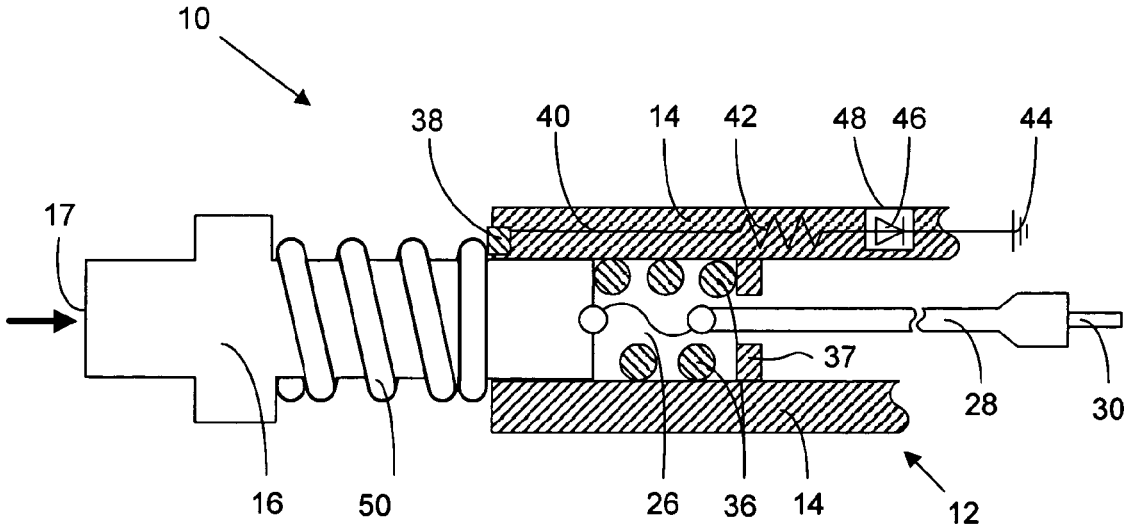
FIG. 2 is an illustration of the cigarette-lighter assembly connector, wherein the plunger is sufficiently retracted to make electrical contact with the light-source terminal via the spring.

As shown in FIGS. 1 and 2, the cigarette-lighter assembly connector 10 includes a housing 12, formed of an electrically insulating material, such as plastic. An electrically conductive plunger 16, formed, e.g., of metal, is mounted for reciprocation (left-to-right, as shown) within a barrel portion 14 of the housing 12. The range over which the plunger 16 can reciprocate is from a left-most extended extremum (as shown in FIG. 1) to a right-most retracted extremum (which the plunger 16 is approaching in FIG. 2). The barrel portion 14 of the housing 12 is substantially cylindrical and has a diameter of about 20 mm (e.g., 16 to 22 mm).

Figure 3:
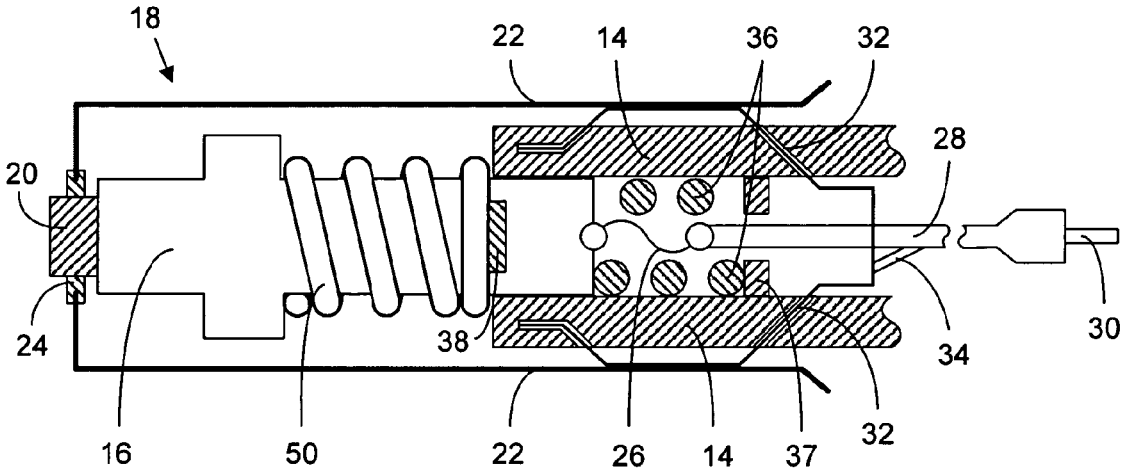
FIG. 3 is an illustration, partially sectioned and partially schematic of the cigarette-lighter assembly connector of FIGS. 1 and 2 (rotated a quarter turn about a horizontal axis, about which the plunger is substantially symmetrical) as the assembly connector is fully inserted into a cigarette-lighter socket.

The plunger 16 includes a contact surface 17 at a remote end. The contact surface 17 interfaces with a cathode 20 in the cigarette-lighter socket 18 into which the assembly connector 10 is mounted, as shown in FIG. 3. The socket 18 also includes a cylindrically shaped anode 22 (having a diameter of about 21 to about 22 mm) that forms the walls of the socket 18. An insulator material 24 (e.g., a ceramic) separates the cathode 20 and anode 22 in the socket 18.

In the assembly connector 10, a fuse 26 is coupled with the plunger 16 to protect the connected portable electronic device from a power surge from the vehicle. A power cable 28 extends from the opposite side of the fuse 26. The power cable 28 can have a length, e.g., of 36 inches. At the opposite end of the power cable 28 can be a connector 30 sized and shaped for coupling with the power input of a portable electronic device. The connector 30 can be, e.g., a HYPERTRONICS Model ARINC 628 connector (from Hypertronics Corporation, Hudson, Mass., USA). Alternatively, the wires of the power cable 28 can be soldered directly to the printed circuit board in the electronic device.

Extending out of the barrel portion 14 of the housing 12 are one or more electrically conductive side terminals 32 (two in the embodiment of FIG. 3). The side terminals 32 can be in the form of metallic leaf springs that penetrate through the barrel portion 14 of the housing 12. As the assembly connector 10 is inserted into the socket 18, the side terminals 32 are compressed inwardly toward the longitudinal axis of the assembly connector 10. As they are compressed, the side terminals 32 press outwardly against the anode 22 of the socket 18, which enables electric current flow there between and which helps to secure the assembly connector 10 in the socket 18 via the force of friction.

The side terminals 32 are joined inside the barrel portion 14 of the housing 12, and an electrically conductive wire 34 is coupled with the side terminals 32 and fed into the power cable 28 to provide a second pathway for electric current flow therein.

A biasing mechanism 36, here in the form of an internal spring mounted against blocks 37, mechanically biases the plunger 16 out of the housing 12 toward the extended extremum (i.e., to the left, as shown). An electrically conductive light-source terminal 38 is mounted on the end of the barrel portion 14 of the housing 12 and is positioned to contact a conductive body 50 (e.g., a metallic spring, as shown in the illustrated embodiments) in electrical contact with the plunger 16 when the plunger 16 is retracted a specified distance from the extended extremum (as shown in FIGS. 2 and 3) via the force (shown with an arrow in FIG. 2) that results from the plunger 16 being pressed against the cathode 20 as the assembly connector 10 is inserted into a socket 18. The countervailing force exerted against the plunger 15 by the biasing mechanism 36 increases as the plunger 16 is further retracted into the housing 12.

The assembly connector 10 is configured so that the plunger 16 will make electrical contact (via the conductive body 50) with the light-source terminal 38 when the extent of plunger retraction is sufficient to ensure that a sufficient bias is produced by the biasing mechanism 36 to produce a sufficiently large contact area between the plunger 16 and the cathode 20 to prevent excessive resistive heating at the plunger/cathode interface. The biasing mechanism can be compressed to provide a force, e.g., of 1.5 to 2 pounds (about 0.7 to about 0.9 kg), when the plunger is retracted 0.12 inches (about 3 mm from its extended extremum). The specified distance of plunger retraction in particular embodiments will be where the plunger 16 is retracted to a position where it is at least as close, if not closer, to its retracted extremum than to its extended extremum.

An electrically conductive wire 40 is coupled with the light-source terminal 38 and fed through the housing 12 to a resistor 42, then to a light source 46, and finally to an electrical ground 44. In the illustrated embodiment, the light source 46 is in the form of a light-emitting diode (LED). The LED is mounted in a cavity beneath a window 48 in the housing 12, the window 48 permitting the penetration from the light source 46 out of the housing 12 so that it can be observed by the driver and/or other passengers in a vehicle when the assembly connector 10 is fully inserted into a dash-mounted cigarette lighter socket 18.

When the biasing mechanism 36 is not compressed, as in FIG. 1, one can see that no conductive pathway exists between the plunger 16 and the light-source terminal 38. And absent an applied voltage, the light source 46 will not emit light. This absence of emitted light will thereby instruct the user that the assembly connector 10 is not fully inserted into the socket 18 and that it is not safe to operate an electronic device coupled with the connector 30 and thereby powered by the assembly connector 10. Written instructions describing the function of the light and its use in determining whether the electronic device can be safely operated are included in the operator's manual that is packaged with the assembly connector 10 for consumer purchase.

In FIG. 2, the conductive body 50, in the form of a metallic detection spring, is retracted along with the plunger 16 toward the housing 12 to a position where the conductive body 50 contacts the light-source terminal 38. Accordingly, the voltage supplied at the cathode 20 of the socket 18 drives electric current through the contact surface 17 of the plunger 16 and into the conductive body 50. Where the conductive body 50 contacts the light-source terminal 38, the current is passed into the electric circuit in the barrel portion 14 of the housing 12, where the electric current is converted into light and emitted through the window 48 in the housing 12. Where the conductive body 50 is a detection spring, the detection spring can provide additional force pressing the plunger 16 against the cathode 20 as the plunger 16 is further retracted into the housing 12 toward the retracted extremum.

The user sees the light generated by the light source and is thereby informed (having read the operator's manual) that the user can safely operate the connected electronic device. The user then turns on the electronic device to generate music, to activate a communications medium, or to provide any of a variety of other functions for which portable electronic devices are engineered to perform. Alternatively, simply inserting the cigarette-lighter assembly connector 10 into the socket 18 may be sufficient to turn on the electronic device to which the cigarette-lighter assembly connector 10 is electronically coupled.

In describing embodiments of the invention, specific terminology is used for the sake of clarity. For purposes of description, each specific term is intended to at least include all technical and functional equivalents that operate in a similar manner to accomplish a similar purpose. Additionally, in some instances where a particular embodiment of the invention includes a plurality of system elements or method steps, those elements or steps may be replaced with a single element or step; likewise, a single element or step may be replaced with a plurality of elements or steps that serve the same purpose. Moreover, while this invention has been shown and described with references to particular embodiments thereof, those skilled in the art will understand that various other changes in form and details may be made therein without departing from the scope of the invention. For example, although the specific embodiments described above employ a light source for indicating the position of the plunger, alternative means, such as an audio transmitter (activated by the voltage to emit, e.g., a chirp) or a mechanical indicator (such as a lever that can be mechanically displaced by the action of the plunger) can be employed.

The invention claimed is:

1. A method for safely powering a portable electronic device, the method comprising:

providing a cigarette-lighter assembly connector including:

a) a housing having a barrel portion that is substantially cylindrical about an axis;

b) an electrically conductive plunger mounted for displacement along the axis of the barrel portion of the housing, the range of axial displacement for the plunger ranging from a retracted extremum to an extended extremum;

c) an electrically conductive light-source terminal positioned to make electrical contact with the plunger only when the plunger is retracted at least a specified distance from the extended extremum;

d) a light source in electrical communication with the light-source terminal such that the light source can be powered to emit light when a voltage is applied to the plunger and when the plunger is retracted at least the specified distance;

e) at least one electrically conductive side terminal extending out of the barrel portion of the housing;

f) a power cable extending from the housing and electrically coupled with the plunger and with the side terminal; and g) at least one spring disposed between the plunger and the barrel portion;

providing a portable electronic device coupled with or couplable with the power cable; and inserting the barrel portion of the housing into a cigarette-lighter socket until the light source is powered to emit light, indicating that the cigarette-lighter assembly connector is inserted sufficiently far into socket to enable safe operation of the portable electronic device.

2. A cigarette lighter assembly connector comprising:

a body including a nozzle;

an electrically conductive plunger axially and slidably mounted within the nozzle, wherein the plunger may reciprocate between a first position and a second position, the plunger having an electrical contact adapted to receive electrical power;

at least one spring disposed between the plunger and the nozzle which provides a force on the plunger from the second position toward the first position;

a power cord with at least one conductive element in electrical communication with the plunger, the power cord adapted to interface with an external electronic device; and an electrical indicator configured such that in the second position of the plunger the electrical indicator is electrically coupled to the electrical contact and in the first position the electrical indicator is electrically isolated from the electrical contact.

3. The cigarette lighter assembly connector of claim 2, wherein the electrical indicator comprises a light.

4. The cigarette lighter assembly connector of claim 2, further comprising a second spring disposed between the plunger and the nozzle.

5. The cigarette-lighter assembly connector of claim 2, wherein the at least one spring is mounted such that the at least one spring exerts an increasingly strong biasing force against the plunger as the plunger is retracted increasingly toward the second position.

6. The cigarette-lighter assembly connector of claim 2, wherein the body comprises plastic.

7. The cigarette-lighter assembly connector of claim 2, wherein the nozzle is sized and shaped so as to be mountable in a cigarette-lighter socket.

8. The cigarette-lighter assembly connector of claim 7, wherein the nozzle has an outer diameter of about 16 to about 22 mm.

9. The cigarette-lighter assembly connector of claim 2, further comprising at least one electrically conductive side terminal extending out of the nozzle.

10. The cigarette-lighter assembly connector of claim 9, wherein the power cord is electrically coupled with the side terminal.

11. The cigarette-lighter assembly connector of claim 10, further comprising a connector that can be coupled with the power input of a portable electronic device, wherein the connector is at an end of the power cord remote from the body and plunger.

12. The cigarette-lighter assembly connector of claim 10, further comprising an electronic device including a printed circuit board that is electrically coupled with the power cord.

13. The cigarette-lighter assembly connector of claim 2, wherein the electrical indicator further comprises:

an electrically conductive light-source terminal positioned to make electrical contact with the plunger only when the plunger is retracted at least a specified distance; and a light source in electrical communication with the light-source terminal such that the light source is powered to emit light when a voltage is applied to the plunger and when the plunger is retracted at least the specified distance.

14. The cigarette-lighter assembly connector of claim 13, further comprising a conductive body mounted on the plunger to provide the electrical contact between the plunger and the light-source terminal.

* * * * *